US005708445A

United States Patent [19]

Moller et al.

[11] Patent Number: 5,708,445

[45] Date of Patent: *Jan. 13, 1998

[54] ANTENNA ASSEMBLY FOR RADIO CIRCUIT AND METHOD THEREFOR

[75] Inventors: Paul J. Moller, Lake Zurich, Ill.; Patrick A. Schwinghammer, Denver, Colo.; Mark W. Schwartz, Wauconda, Ill.

[73] Assignee: Motorola, Inc., Schaumburg, Ill.

[ * ] Notice: The term of this patent shall not extend beyond the expiration date of Pat. No. 5,572,224.

[21] Appl. No.: 24,545

[22] Filed: Mar. 1, 1993

Related U.S. Application Data

[63] Continuation-in-part of Ser. No. 425,694, Apr. 19, 1995, Pat. No. 5,572,224, which is a continuation of Ser. No. 11,016, Jan. 29, 1993, abandoned.

[51] Int. Cl.[6] ..... H01Q 1/24

[52] U.S. Cl. ..... 343/702; 343/752; 343/895; 343/901

[58] Field of Search ..... 343/895, 702, 343/752, 900, 901; H01Q 1/24, 9/40, 1/36, 11/08

[56] References Cited

U.S. PATENT DOCUMENTS

| | | | |
|---|---|---|---|
| 4,644,366 | 2/1987 | Scholz | 343/702 |
| 4,868,576 | 9/1989 | Johnson | 343/702 |
| 5,262,792 | 11/1993 | Egashira | 343/702 |
| 5,572,224 | 11/1996 | Moller et al. | 343/702 |

FOREIGN PATENT DOCUMENTS

| | | | |
|---|---|---|---|
| 509729 | 7/1939 | United Kingdom | 343/752 |

*Primary Examiner*—Michael C. Wimer

*Attorney, Agent, or Firm*—Randall S. Vaas; Robert H. Kelly

[57] ABSTRACT

An antenna assembly, and associated method, for a radio, such as a portable radiotelephone, which is of minimal physical dimensions and which is operable over a wide range of frequencies. A length of wire is helically-shaped and includes at least a portion of a winding. A capacitive top-hat is positioned at an end portion of the wire. By increasing the number of windings of the wire, the height of the antenna assembly is reduced, but such reduction also reduces the size of the bandwidth of frequencies over which the antenna assembly is operable. Increase in the size of the surface area of the capacitive top-hat increases the size of the bandwidth over which the antenna assembly is operable. Selection of the top-hat size and the number of windings permits beth physical dimensions of the antenna assembly and the size of the bandwidth to be selected.

19 Claims, 4 Drawing Sheets

ANTENNA ASSEMBLY FOR RADIO CIRCUIT AND METHOD THEREFOR

This application is a continuation-in-part of U.S. patent application Ser. No. 08/425,694, filed on Apr. 19, 1995, now U.S. Pat. No. 5,572,224, which is a continuation of application Ser. No. 08/011,016, filed on Jan. 29, 1993, abandoned.

BACKGROUND OF THE INVENTION

The present invention relates generally to antenna assemblies and, more particularly, to an antenna assembly, and an associated method, for a portable radio operable to transmit or receive, or both transmit and receive, high-frequency, modulated signals.

A communication system is comprised, at a minimum, of a transmitter and a receiver interconnected by a transmission channel. A communication signal is transmitted upon the transmission channel, thereafter to be received by the receiver.

A radio communication system is a communication system in which the transmission channel comprises a radio frequency channel wherein the radio frequency channel is defined by a range of frequencies of the electromagnetic frequency spectrum. A transmitter operative in a radio communication system converts the communication signal to be transmitted into a form suitable for transmission thereof upon the radio frequency channel.

Conversion of the communication signal into the form suitable for the transmission thereof upon the radio frequency channel is effectuated by a process referred to as modulation. In such a process, the communication signal is impressed upon an electromagnetic wave. The electromagnetic wave is commonly referred to as a "carrier signal." The resultant signal, once modulated by the communication signal, is referred to as a modulated carrier signal, or, more simply, a modulated signal. The transmitter includes circuitry operative to perform such a modulation process.

Because the modulated signal may be transmitted through free space over large distances, radio communication systems are widely utilized to effectuate communication between a transmitter and a remotely-positioned receiver.

The receiver of the radio communication system which receives the modulated carrier signal contains circuitry analogous to, but operative in a manner reverse with that of, the circuitry of the transmitter and is operative to perform a process referred to as demodulation.

Numerous modulated carrier signals may be simultaneously transmitted as long as the signals are transmitted along differing radio frequency channels defined upon the electromagnetic frequency spectrum. Regulatory bodies have divided portions of the electromagnetic frequency spectrum into frequency bands and have regulated transmission of the modulated signals upon various ones of the frequency bands. The frequency bands are further divided into channels, and such channels form the radio frequency channels of a radio communication system. It is of course to be understood that separate channels may also be defined over a single range of frequencies when signals are transmitted in a discontinuous manner, such as, e.g., in a time division multiple access (TDMA) communication scheme.

A two-way radio communication system is a radio communication system, similar to the radio communication system above-described, but which permits both transmission of a modulated signal from a location and reception at such location of a modulated signal. Each location of such a two-way communication system contains both a transmitter and a receiver. The transmitter and the receiver positioned together at the single location typically comprise a unit referred to as a radio transceiver or, more simply, a transceiver.

A cellular communication system is one type of two-way radio communication system and, when operative, communication is permitted with a radio transceiver positioned at any location within a geographic area encompassed by the cellular communication system.

A cellular communication system is created by positioning a plurality of fixed-site radio transceivers, referred to as base stations, at spaced-apart locations throughout a geographic area. The base stations are connected to a conventional, wireline, telephonic network. Associated with each base station of the plurality of base stations is a portion of the geographic area encompassed by the cellular communication system. Such portions are referred to as cells. Each of the plurality of cells is defined by one of the base stations of the plurality of base stations, and the plurality of cells together define the coverage area of the cellular communication system.

A radio transceiver, referred to in a cellular communication system as a cellular radiotelephone or, more simply, a cellular phone, positioned at any location within the coverage area of the cellular communication system, is able to communicate with a user of the conventional, wireline, telephonic network by way of a base station. Modulated signals generated by the radiotelephone are transmitted to a base station, and modulated signals generated by the base station are transmitted to the radiotelephone, thereby to effectuate two-way communication therebetween. (A signal received by a base station is then transmitted to a desired location of a conventional, wireline network by conventional telephony techniques. And, signals generated at a location of the wireline network are transmitted to a base station by conventional telephony techniques, thereafter to be transmitted to the radiotelephone by the base station.)

Certain designs of radio transceivers operable in cellular communication systems, as well as other radio communication systems, are of dimensions permitting their carriage by a user. Such portable radio transceivers are typically comprised of telephonic handsets which are somewhat analogous in appearance with telephonic handsets of conventional, telephonic apparatus. Namely, such portable transceivers include speaker portions and microphone portions supported in the handsets at spaced distances permitting a user thereof simultaneously to listen to signals transmitted to the transceiver and to generate signals therefrom.

Advancements in electronic circuitry design have permitted increased miniaturization of the electronic circuitry comprising such radiotelephones (as well as other radio communication apparatus). As a result of such miniaturization, radiotelephones may be housed in increasingly-smaller packages thereby to increase the convenience of carriage of such radiotelephones.

Additional efforts to miniaturize further the electronic circuitry of such radiotelephones (as well as other radio communication apparatus) are ongoing. Such further miniaturization of radiotelephones comprised of such circuitry shall further increase the convenience of carriage of such radiotelephones.

As antenna structure forms portions of radiotelephones, concomitant attempts are being made also to reduce the physical dimensions of such structure.

To ensure that the antenna structure is able to receive and transmit signals properly, the antenna structure should be positioned to extend beyond the radio circuitry which is typically disposed upon one or more electrical circuit boards and housed within a radio housing. When the radio housing is comprised of a thermoplastic (or other electromagnetic wave-nonreflective or—nonabsorptive) material, the antenna structure may also be enclosed within the radio housing. By forming the radio housing to be slightly elongated, the antenna structure, if of small-enough dimensions, and the radio circuitry may both be housed within the radio housing.

Several designs of radio transceivers include radio transceiver housings in which the end portions of the housings are slightly elongated whereat antennas may be positioned while still being supportively enclosed by the transceiver housings. The extent of such elongation of the transceiver housing is slight both to minimize the physical dimensions of the radio transceiver and also for aesthetic reasons. Accordingly, the antenna structure must be of physical dimensions permitting positioning of the antenna within the transceiver housing and, thus, be of less than maximum heighthwise, widthwise, and depthwise dimensions.

But, in reducing the physical dimensions of the antenna structure, some of the performance parameters of the antenna structure may be deleteriously affected. One such performance parameter of antenna structure is the magnitude of the frequency bandwidth over which the antenna structure is operative. When antenna structure is constructed to be of reduced physical dimensions, consideration must be given to the operable, frequency bandwidth of such antenna structure to ensure that the magnitude of the frequency bandwidth over which the antenna of the reduced physical dimensions is operable is of an acceptable bandwidth.

Antenna structure coupled to a radiotelephone typically includes (or is comprised solely of) a wire of a length substantially corresponding to the length of one-quarter the wavelength of signals to be received by, or transmitted from, the antenna. An antenna of such a length is of a low impedance (e.g., approximately fifty ohms) which substantially matches the impedance of most electronic circuitry (e.g., also approximately fifty ohms) and, here in particular, the circuitry comprising most designs of radiotelephones.

A simple means by which the heighthwise dimensions of the length of wire may be reduced is to form windings in the length of wire. Formation of such windings causes the length of wire to be of a helical shape. The helically-shaped wire is of a reduced heighthwise dimension relative to the heighthwise dimension of a corresponding straight length of wire. The physical dimensions of an antenna structure including a helically-shaped length of wire is of reduced physical dimensions in a heighthwise direction relative to the heighthwise dimension of a corresponding antenna structure having a straight length of wire. However, by forming such windings, the size of the frequency bandwidth over which the antenna structure is operable is reduced.

Because of such reduction in the range of frequencies over which an antenna is operable when windings are formed therein, a reduction in the physical dimensions of an antenna merely by introducing windings therein is oftentimes an unacceptable means for reducing the physical dimensions of the antenna.

What is needed, therefore, is an antenna structure of minimal physical-dimensional requirements, and a method for forming such, which is permitting of operation thereof over a frequency bandwidth of an acceptable magnitude.

SUMMARY OF THE INVENTION

The present invention, accordingly, advantageously provides an antenna assembly of selected antenna characteristics which is of reduced physical-dimensional requirements.

The present invention further advantageously provides an antenna assembly of the selected antenna characteristics for a radio having radio circuitry.

The present invention yet further advantageously provides a radio transceiver having an antenna assembly of selected antenna characteristics and of minimal physical-dimensional requirements forming a portion of the radio transceiver.

The present invention yet further advantageously provides a method of positioning an antenna assembly of selected antenna characteristics.

The present invention includes further advantages and features, the details of which will be more apparent after reading the detailed description of the preferred embodiments hereinbelow.

In accordance with the present invention, therefore, an antenna assembly of selected antenna characteristics, and an associated method, for a radio having radio circuitry housed within a radio housing body is disclosed. A first antenna portion is formed of an electrically-conductive wire configured in a helical shape having at least a portion of a winding defining the helical shape thereof. The electrically-conductive wire has a proximal side portion and a distal side portion comprised of portions of the wire beyond proximal and distal ends, respectively, of the at least portion of the winding. The proximal side portion of the wire is coupled to the radio circuitry. A second antenna portion is formed of a capacitive top-hat coupled to the distal side portion of the wire forming the tint antenna portion. The top-hat is of a surface area of a magnitude related to numbers of windings of the electrically-conductive wire and is selected such that the numbers of windings of the wire and the magnitude of the surface area of the top-hat are together determinative of the antenna characteristics.

BRIEF DESCRIPTION OF THE DRAWING

The present invention will be better understood when read in light of the accompanying drawings in which.

DESCRIPTION OF THE PREFERRED EMBODIMENTS

As mentioned hereinabove, because of miniaturization of the electronic circuitry comprising radio transceivers, such as radiotelephones operative in a cellular communication system, such radio transceivers may be constructed to be housed in innreasingly-smaller packages. Concomitant with ongoing attempts to miniaturize further the circuitry of the radio transceivers, attempts are also being made to reduce the physical dimensions of antenna structure which form portions of the radio transceivers.

A simple means by which the heighthwise dimensions of an antenna formed of a length of wire may be reduced is merely by configuring the length of wire into a helical shape having at least a portion of a winding. However, by reducing the heighth of the length of wire forming the antenna by configuring the wire into the helical shape, the range of frequencies, i.e., the bandwidth, over which the antenna is operational is reduced. Accordingly, a simple reduction in the heighthwise dimensions of a length of wire by configuring the wire into a helical shape may be an unacceptable means by which to reduce the heighthwise dimensions of the antenna.

Figure 1:
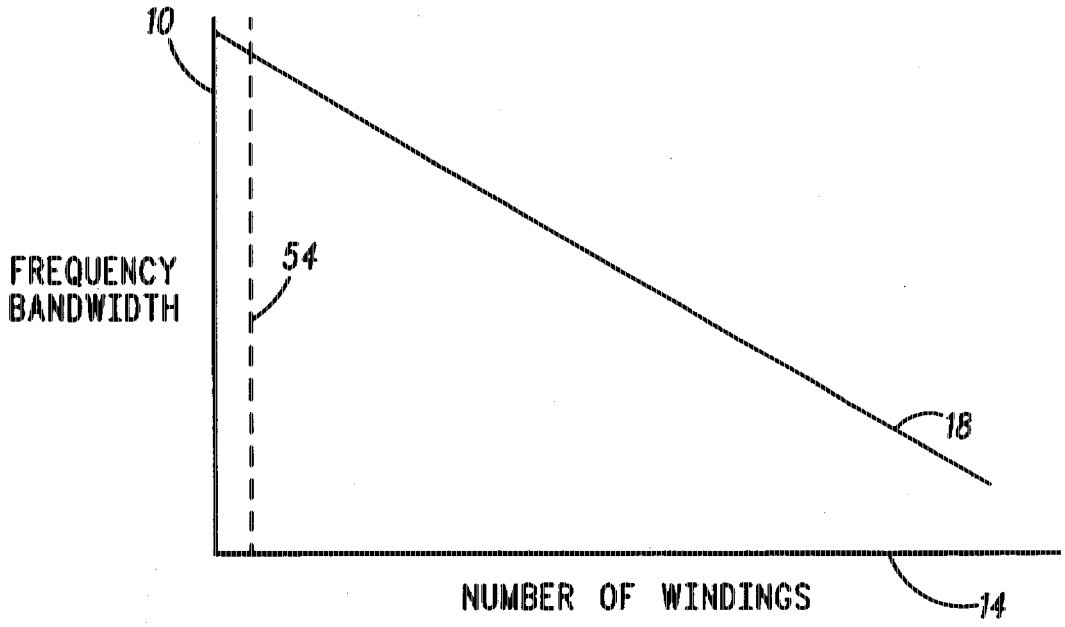
FIG. 1 is a graphical representation illustrating the relationship between the number of windings formed of the electrically-conductive wire forming a portion of the antenna assembly of a preferred embodiment of the present invention and magnitudes of frequency bandwidths over which the antenna assembly is operable.

FIG. 1 is a graphical representation illustrating the general relationship between the number of windings of a length of wire configured into a helical shape and magnitudes of frequency bandwidths over which an antenna, formed of the length of wire including such helical winding, is operable. In the graphical representation of the figure, the magnitude of the frequency bandwidth, scaled in terms of hertz, is plotted along ordinate axis 10 as a function of the number of windings formed in the length of wire, plotted along abscissa axis 14.

Curve 18 is a plot of the frequency magnitude of the bandwidth formed as a function of the number of windings formed in the length of wire. It should be noted that, while curve 18 is illustrated in the figure as a straight line, the relationship between the number of windings of the length of wire and the magnitude of the frequency bandwidth over which the antenna formed of the length of wire is not necessarily linear and may be of other configurations. Curve 18 is illustrated in the figure to indicate that the magnitude of the bandwidth over which the antenna is operable is inversely related to the number of windings formed in the length of wire. (Viz., while the relationship may not be linear, the general inverse relationship is representative of the relationship between the number of windings And the magnitude of the frequency bandwidth.) By increasing the number of windings, the size of the bandwidth over which the antenna is operable is reduced.

Vertically-extending line 24, shown in hatch, is also shown in the graphical representation of FIG. 1. Line 24 represents a physical-dimensional constraint limiting maximum physical dimensions, here a heighthwise dimension, of an antenna formed of a length of wire. Line 24 is shown at the left-hand side portion of the graphical representation of FIG. 1 to indicate that a length of wire configured to include fewer than a certain number of windings is of a heighthwise dimension greater than an allowable value. As mentioned previously, an antenna forming a portion of a portable radio transceiver usually must be positioned beyond the transceiver circuitry, typically disposed upon one or more electrical circuit beards. Such positioning ensures that signals generated therefrom and signals transmitted thereto are properly transmitted and received.

As mentioned previously, several designs of radio transceivers include radio transceiver housings having slightly elongated, end portions whereat antennas may be positioned while still being supportively enclosed by the transceiver housings. The extent of such elongation of the transceiver housing is slight both to minimize the physical dimensions of the radio transceiver and also for aesthetic reasons. In such an embodiment, accordingly, the antenna must be of physical dimensions permitting positioning of the antenna within the transceiver housing and, thus, be of less than maximum heighthwise, widthwise, and depthwise dimensions.

The positioning of vertically-extending line 24 may, in such an embodiment, be envisioned to indicate that an antenna formed of a length of wire and housed within a transceiver housing having a slightly elongated end portion must include at least a portion of a winding to reduce thereby the heighthwise dimension of the antenna such that the heighth of the antenna is less than the maximum heighth, indicated by line 24.

As shown by curve 18, while formation of the at least portion of the winding in the length of wire forming the antenna reduces the heighthwise dimension thereof, such formation of the winding also causes a reduction in the magnitude of the bandwidth over which the antenna so-formed is operable.

To counteract the reduction in the magnitude of the bandwidth over which the antenna formed of the length of wire due to the formation of the at least portion of the winding, a capacitive top-hat my be placed at an end portion of the length of wire comprising the antenna. A capacitive top-hat is merely a capacitive plate which, when placed near a top end of a length of wire appears somewhat to be a hat positioned upon the length of wire. Such positioning of the top-hat increases the size of the bandwidth and alters the center frequency of the bandwidth over which the antenna, now including the capacitive top-hat as a portion thereof, is operable. Positioning of the top-hat upon the length of wire reduces the center frequency of the bandwidth over which the antenna formed of the length of wire together with the top-hat is operable while also increasing the frequency magnitude of the bandwidth.

Figure 2:
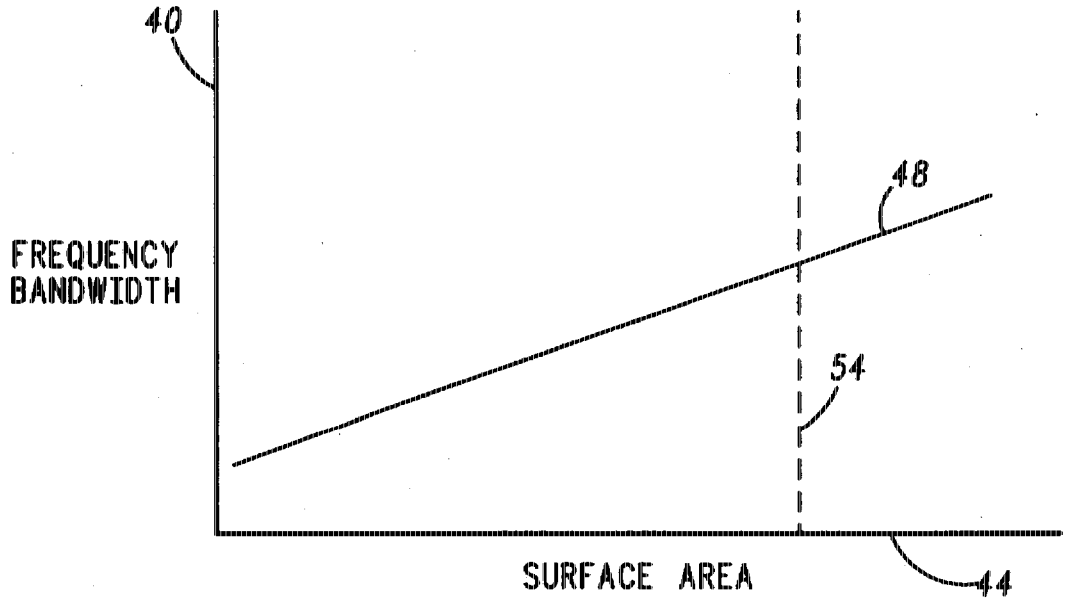
FIG. 2 is a graphical representation illustrating the relationship between magnitudes of the surface area of the capacitive top-hat forming a portion of the antenna assembly of a preferred embodiment of the present invention and magnitudes of frequency bandwidths over which the antenna assembly is operable.

FIG. 2 is a graphical representation illustrating the general relationship between magnitudes of the surface area of such a capacitive top-hat and the magnitude of the bandwidth over which an antenna including such a capacitive top-hat is operative. The magnitude of the bandwidth is scaled along ordinate axis 40 in terms of hertz, and the surface area of the top-hat is scaled along abscissa axis 44 in terms of square centimeters.

Curve 48 is illustrated in the figure to indicate that the magnitude of the operational bandwidth of an antenna, including such a top-hat is directly related to the magnitude of the surface area of the top-hat. As the surface area of the top-hat increases, the size of the bandwidth over which an antenna including the top-hat is operable increases. It should also be noted that, while curve 48 is illustrated in the figure as a straight line, the relationship between the magnitude of the surface area of the top-hat and the magnitude of the frequency bandwidth over which the antenna is operable is not necessarily linear and may be of other configurations. In other words, while the relationship may not be linear, the general direct relationship is representative of the relationship between magnitude of the surface area of the top-hat and the magnitude of the bandwidth over which the antenna is operational.

Hence, when the heighth of a length of an electrically-conductive wire forming an antenna must be reduced by introducing at least a portion of a winding therein to form the wire into a helical shape, positioning of a capacitive top-hat at an end portion of the electrically-conductive wire counteracts the reduction in the size of the bandwidth of the antenna caused by the formation of the winding in the length of wire.

However, due to the aforementioned physical dimensional constraints limiting the heighthwise, widthwise, and depthwise dimensions of the antenna in a portable radiotelephone, the maximum size of the top-hat positioned at the end of the length of wire is limited.

Vertically-extending line 54 shown in hatch, is also shown in the graphical representation of FIG. 2. Line 54 represents a physical dimensional constraint limiting maximum physical dimensions, here a surface area formed of widthwise and depthwise dimensions of the top-hat. Line 54 is shown at the right-hand side portion of the graphical representation of FIG. 2 to indicate that a capacitive top-hat of greater than a certain surface area is of dimensions greater than permissible dimensions due to the physical dimensional constraints.

Due to the physical-dimensional constraints limiting maximum physical dimensions of an antenna in each of three dimensions (namely, in the heighthwise, widthwise, and depthwise dimensions), when constructing an antenna to be of desired performance parameters (namely, when constructing an antenna to be operable over a frequency bandwidth of a desired magnitude), consideration must be given to not only the performance parameters of the antenna but also the physical dimensions thereof.

An antenna of desired performance parameters may, however, in many instances, be constructed to be of physical dimensions within the maximum physical heighthwise, widthwise, and depthwise dimensions by an appropriate combination of windings introduced upon a length of wire and a capacitive top-hat of a surface area of a selected magnitude. When the lengthwise dimension of the antenna must be reduced, additional numbers or portions of numbers of windings may be formed to configure the length of wire into a helical shape and the surface area of a top-hat may be increased to counteract the reduction in the size of the bandwidth resulting in the increased numbers of windings. A proper balance between reduced heighthwise dimensions and reduced widthwise and depthwise dimensions of the top-hat of the antenna permits an antenna to be formed to be of any of a range of desired performance parameters. Because the surface area of the top-hat is dependent upon beth lengthwise and widthwise dimensions, beth the lengthwise and also widthwise dimensions of the top-hat may be varied to form top-hat of a desired surface area.

When constructing an antenna according to a method of a preferred embodiment of the present invention, windings are introduced in the length of wire to reduce the heighthwise dimensions of the wire such that the heighth of the wire is of a magnitude within a maximum allowable value. An oversized top-hat is positioned at an end portion of the wire (for the reason that an oversized top-hat may be easily reduced in size). The performance parameters of the antenna assembly formed of the length of wire and the top-hat are quantitatively determined. Portions of the top-hat are cut away, if necessary, to reduce the widthwise and depthwise dimensions thereof, and the performance parameters of the antenna assembly are again determined to ensure that the antenna assembly is of desired performance parameters. (As mentioned previously, positioning of the top-hat upon the length of wire reduces the center frequency of the frequency bandwidth over which the antenna formed of the length of wire together with the top-hat is operable while increasing the magnitude of the bandwidth. As portions of the top-hat are removed, the center frequency increases and the magnitude of the frequency bandwidth over which the antenna is operable is reduced.) Once the dimensions of the top-hat are determined, additional numbers of antenna assemblies may be constructed using the top-hat dimensions of the top-hat of the first-constructed antenna assembly as a model.

Figure 3:
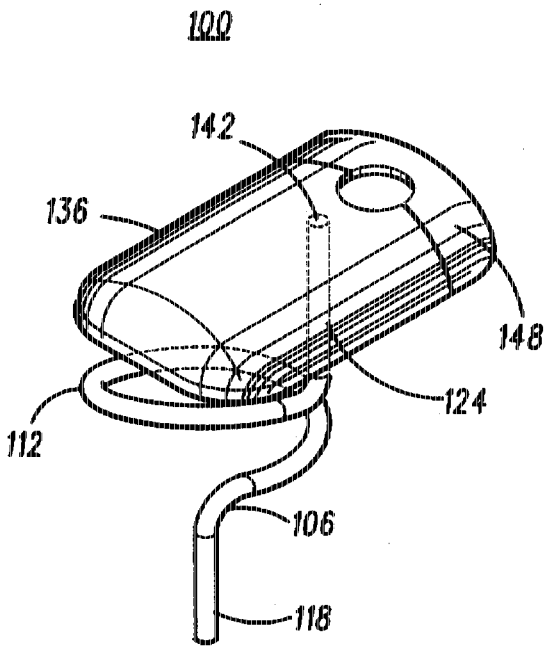
FIG. 3 is a perspective view, taken in isolation, of the antenna assembly of a preferred embodiment of the present invention.

Turning next to the perspective view of FIG. 3, an antenna assembly, referred to generally by reference numeral 100, of a preferred embodiment of the present invention is shown in isolation. Antenna assembly 100 is comprised of a first antenna portion formed of a length of an electrically conductive wire 106 which is configured into a helical shape by the formation of winding 112. Proximal side portion 118 of wire 106 is formed of portions of wire 106 which extend beyond a proximal end of winding 112. And, distal side portion 124 of wire 106 extends beyond a distal end of winding 112.

Capacitive top-hat 136 is electrically connected to wire 106 and is positioned to abut against an end of distal side portion 124 of wire 106. In a preferred embodiment of the present invention, top-hat 136 and wire 106 are electrically connected theretogether by way of a solder connection, indicated by the small x-markings 142 illustrated in the figure.

In other embodiments, an aperture extends through top-hat 136 permitting extension of an end of distal side portion 124 of wire 106 therethrough. Wire 106 and capacitive top-hat 136 may then be electrically connected theretogether.

Wire 106 is of an electrical length somewhat less than the length of a one-quarter wavelength of signals to be transmitted or received by assembly 100 such that wire 106 together with top-hat 136 is of an electrical length of the one-quarter wavelength. Because wire 106 is of such a length, antenna assembly 100 is of a low feed point impedance (e.g., of approximately fifty ohms) which substantially matches the impedance of conventional radio circuitry (not shown in FIG. 3 but also of, e.g., approximately fifty ohms) to which assembly 100 is coupled at proximal side 118 of wire 106.

Capacitive top-hat 136 is comprised of a portion of a transversely-extending, dome member formed of a drawn sheet of metallic material. In a preferred embodiment of the present invention, top-hat 136 is formed of only the pertion of a dome member as the surface area required of the top-hat 136 does not require a top-hat of a surface area corresponding to the surface area of the entire dome member. The entire dome member also includes portions shown in hatch in the figure.

Aperture 148 is further shown in the figure which extends between top and bettom face surfaces of capacitive top-hat 136. Aperture 148 is offset from wire 106 which forms the first antenna pertion of antenna assembly 100. Aperture 148 permits extension of an antenna whip, not shown in the figure, therethrough.

By appropriate selection of the number of windings 112 into which wire 106 is configured and the size of the surface area of capacitive top-hat 136, antenna assembly 100 may be configured to be of desired performance parameters while limiting the physical dimensions of the component portions of assembly 100 to be less than maximum, allowable dimensions. In the preferred embodiment illustrated, winding 112 is formed of one and one-quarter turns and capacitive top-hat 136 is of a surface area of three square centimeters. Because of the non-integer number of turns, proximal and distal side portions 118 and 124 of wire 106 have longitudinal axes which extend in parallel directions, but which are offset from one another.

By increasing the number of windings, the heighth of wire 106 may be reduced, and, commensurate increase in the surface area of top-hat 136 permits the size of the bandwidth over which antenna assembly 100 is operable to be increased. The preferred embodiment, having wire 106 of the first antenna portion configured as shown in FIG. 3 and of a length of approximately two and one-half centimeters to include winding 112 of one and one-quarter windings and top-hat 136 of a surface area of approximately one and one-half square contimeters is operable over a frequency band-width of a size of one hundred Megahertz (MHz) at a conter frequency of 1.8 Gigahertz (GHz).

Figure 4:
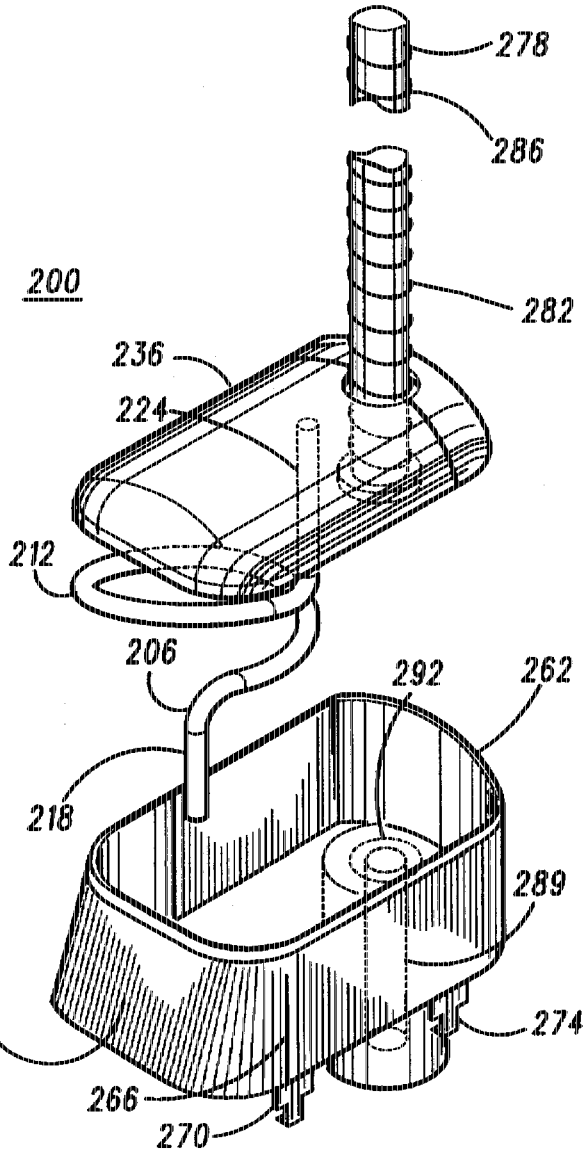
FIG. 4 is a perspective view, taken in isolation and similar with that of FIG. 3, but of an antenna assembly of an alternate, preferred embodiment of the present invention.

Turning next to the perspective view of FIG. 4, an antenna assembly, referred to generally by reference numeral 200, of an alternate, preferred embodiment of the present invention is shown. Antenna assembly 200, similar to antenna assembly 100 of FIG. 3 is comprised of first and second antenna portions and is constructed to be of minimal physical dimensions while permitting operation thereof to transmit or to recoive signals over a wide range of frequencies.

Accordingly, the first antenna portion of antenna assembly 200 is comprised of a length of wire 206 which includes winding 212 to configure wire 206 into a helical shape. Proximal side portion 218 of wire 206 is comprised of portions of wire 206 which extend beyond a proximl side of winding 212. And, distal side portion 224 of wire 206 is formed of portions of the wire which extend beyond a distal side end of winding 212.

Capacitive top-hat 236 forms the second antenna portion of antenna assembly 200 and is positioned at an end of distal side portion 224 of wire 206 to be electrically connected therewith. Again, the capacitive top-hat is formed of a cutaway portion of a transversely-extending, dome member. The number of windings 212 and the surface area of capacitive top-hat 236 are again selected to minimize the physical dimensions of the assembly 200 while permitting the antenna assembly formed of the antenna portions to be operable over a wide range of frequencies.

Antenna assembly 200 of FIG. 4 further comprises supportive plug member 256 having top face surface 262 permitting a bottom face surface of capacitive top-hat 236 to seat thereupon. Top face surface 262 of plug member 256 is thereby operative to suppert top-hat 236 thereupon. A longitudinally-extending slot 266 extends through supportive plug member 256 to permit extension of wire 206 theret. hrough. At least sn end of proximal side pertion 218 of wire 206 extends beneath a bettom face surface of plug member 256. Positioning prongs 270 and 274 project beneath a bottom face surface of ping member 256. Prong members 270 and 274 are operative to facilitate positioning of the antenna assembly to permit electrical connection of an end pertion of proximal side portion 218 of wire 206 with radio circuitry (not shown in the figure). Plng member 256 is preferably comprised of an insert-molded, thermoplastic material.

Antenna whip 278 is also shown in the figure. Antenna whip 278 is comprised of a longitudinally-extending rod member formed of a length of thermoplastic material. Helical windings 282 and 286 are supported about whip 278. Antenna whip 278 is translatable along a longitudinal axis thereof thereby to permit capacitive coupling of winding 282 or 286 with top-hat 236. Slot 289 also extends throngh supportive plug member 256 to permit translation of antenna whip 278 therethrough.

Again, by proper selection of the number of windings 212 formed in wire 206 to form wire 206 into the helical shape and by proper selection of the size of the surface area of top-hat 236, antenna assembly 200 may be of physical dimensions within any of many physical-dimensional constraints while still being operable over a large band of frequencies centered about a desired center frequency. Because supperfive plng member is no greater is widthwise and depthwise dimensions than is top-hat 236 and is of heighthwise dimensions no greater than the heighthwise dimensions of wire 206, supportive ping member 256 may be positioned within the housing of a radio transceiver along with the first and second antenna portions comprised of wire 206 and capacitive top-hat 236 without requiring any increase in the size of the transceiver housing.

Figure 5:
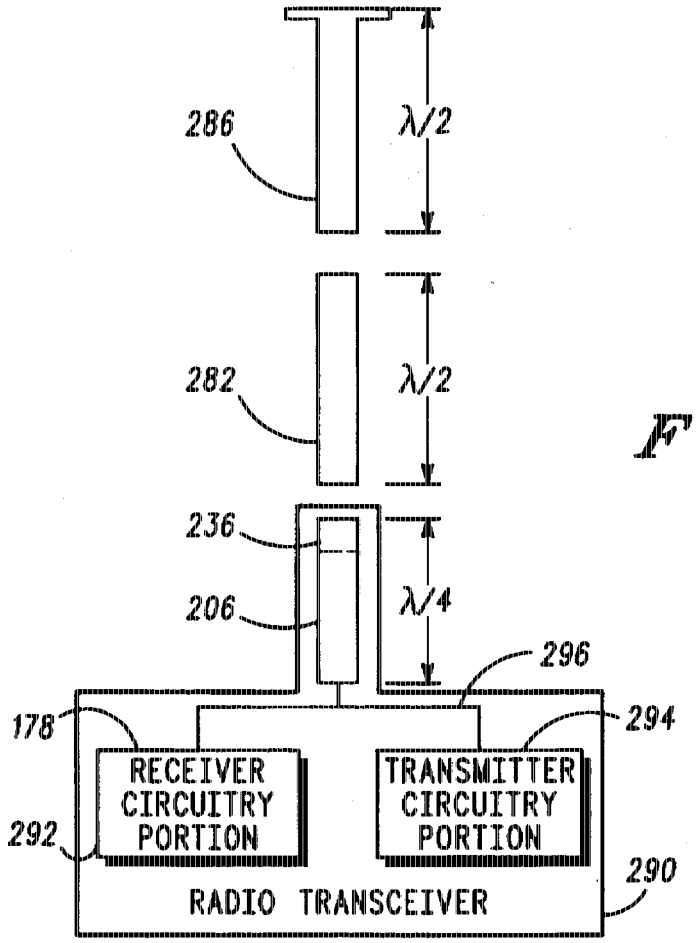
FIG. 5 is a partial block, partial schematic view of the antenna assembly of FIG. 4 coupled to a radio transceiver.

FIG. 5 is a partial block, partial schematic diagram of antenna assembly 200, shown in isolation in FIG. 4. The view of FIG. 5 further shows antenna assembly 200 in connection with radio transceiver circuitry 290 which is comprised of receiver circuitry portion 292 and transmitter circuitry portion 294.

Electrically-conductive wire 206 and capacitive top-hat 236 are represented by blocks in the figure. Wire 206 is electrically connected to the receiver circuitry portion 292 and transmitter circuitry portion 294 of radio transceiver 290 by way of connecting line 296. And, as described previously, capacitive top-hat 236 is electrically connected to wire 206. As beth wire 206 and top-hat 236 are positioned within a transceiver housing in which receiver and transmitter circuitry portions 292 and 294 are also positioned, wire 206 and top-hat 236 are shown within the block identifying radio transceiver 290. Helical windings 282 and 286 which are positioned about antenna whip 278 are also shown in FIG. 4 and are positioned to extend beyond the housing of transceiver 290 in which wire 206 and top-hat 236 are positioned. In the position illustrated, helical winding 282 is capacitively coupled to top-hat 236, and helical winding 286 is capacitively coupled to winding 282.

Figure 6:
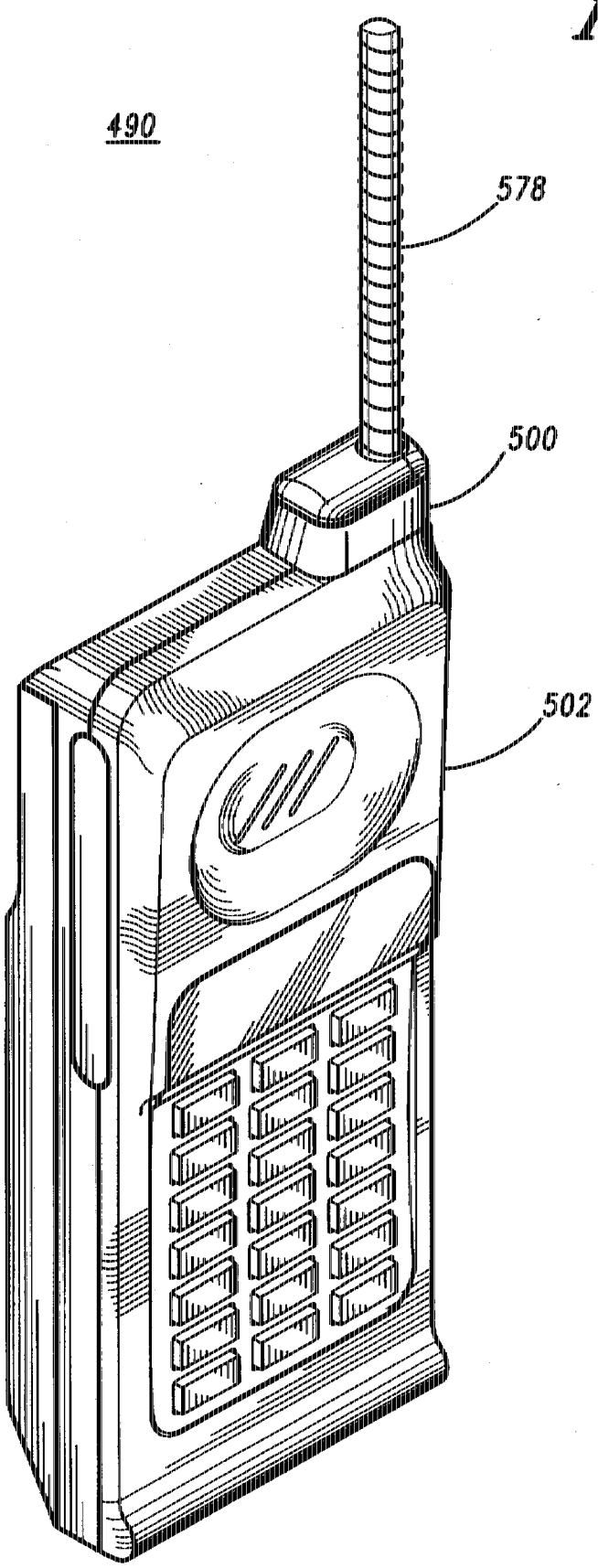
FIG. 6 is a perspective view of a radiotelephone which incorporates the antenna assembly of FIG. 4 as a portion thereof.

Turning next to the perspective view of FIG. 6, a radiotelephone, referred to generally by reference numeral 490 of a preferred embodiment of the present invention is shown. Radiotelephone 490 includes an antenna assembly, here referred to by reference numeral 500 as a portion thereof within an elongated end pertion of housing 502 of radiotelephone 490. Because antenna assembly 500 may be constructed to be of minimal physical dimensions in heighthwise, widthwise, and depthwise dimensions, while still being operable over a wide range of frequencies, the antenna assembly may be positioned within the housing 502 of radiotelephone 490 to be supported therewithln while permitting an aesthetically-pleasing transceiver housing appearance. In the embodiment of radiotelephone 490 of FIG. 6, antenna whip 578 is further positioned to extend beyond the body of radiotelephone housing 502. It should be noted that radiotelephone 490 is operative without an antenna whip having helical windings positioned thereabout such as antenna whip 578 of FIG. 6, and that signals transmitted to radiotelephone 490 and signals generated by radiotelephone 490 may be received and transmitted, respectively by antenna assembly 500 housed entirely within radiotelephone housing 502.

Figure 7:
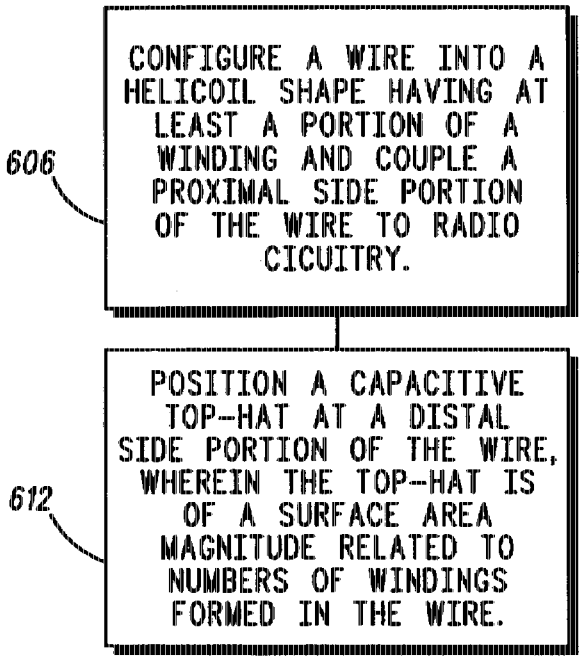
FIG. 7 is a logical flow diagram listing the method stops of the method of a preferred embodiment of the present invention.

Finally turning now to the logical flow diagram of FIG. 7, the method steps of a method, referred to generally by reference numeral 600, of a preferred embodiment of the present invention are listed. Method 600 positions an antenna assembly of selected antenna characteristics at a radio having radio circuitry housed within a radio housing body. First, and as indicated by block 606, a pro-real side portion of an electrically-conductive wire configured in a helical shape having at least a portion of a winding deigning the helical shape thereof is coupled to the radio circuitry of the radio. Next, and as indicated by block 612, a capacitive top-hat having a surface area of a magnitude related to numbers of windings of the electrically-conductive wire is coupled to a distal side portion of the electrically-conductive wire wherein the numbers of windings of the wire and the magnitude of the surface area of the top-hat are together determinative of the antenna characteristics.

While the present invention has been described in connection with the preferred embodiments shown in the various figures, it is to be understood that other similar embodiments may be used and modifications and additions many be made to the described embodiments for performing the same function of the present invention without deviating therefrom. Therefore, the present invention should not be limited to any single embodiment, but rather construed in breadth and scope in accordance with the recitation of the appended claims.

What is claimed is:

1. An antenna assembly of selected antenna characteristics for a radio having radio circuitry housed within a radio housing body, the antenna assembly comprising:

an electrically-conductive wire positioned in the radio housing body and having at least a portion of a winding formed therein to configure the electrically-conductive wire into a coiled shape, the electrically-conductive wire having a proximal end portion and a distal end portion wherein the proximal end portion is coupled to the radio circuitry;

a top-hat positioned in the radio housing body, the top hat including a first electrical coupling portion coupled to the distal end portion of the wire, wherein the top-hat is of a surface area of a magnitude related to numbers of windings formed in the electrically-conductive wire and is selected such that the number of windings of the wire and the magnitude of the surface area of the top-hat are together determinative of the antenna characteristics, and the top hat including a second electrical coupling portion for electrically coupling the top hat to an antenna associated with a projecting rod, the first and second electrical coupling portions spaced from one another; and a rod including a rod coil carried thereon, the rod and coil extending through the top hat and out of the radio housing body in an extended position, the rod coil coupled to the top hat at the second electrical coupling portion when the rod is in the extended position, whereby the rod coil is coupled to the radio circuitry via the top hat and the electrically conductive wire when the rod is in the extended position.

2. The antenna assembly of claim 1 wherein the wire comprises a non-integer number of windings.

3. The antenna assembly of claim 2 wherein the proximal end portion and the distal, end portion of the electrically-conductive wire extend in parallel directions.

4. The antenna assembly of claim 3 wherein the proximal end portion and the distal end portion of the electrically-conductive wire each define longitudinally-extending axes, wherein the longitudinally-extending axis defined by the proximal end portion of the wire extends in a direction offset with respect to a direction in which the longitudinally-extending axis defined by the distal end portion of the wire extends.

5. The antenna assembly of claim 1 wherein the wire is of a length comprising a low impedance antenna at a frequency of operation of the radio circuitry of the radio.

6. The antenna assembly of claim 1 wherein the electrically-conductive wire is of a length substantially corresponding to the length of one-quarter wavelength of a signal of a frequency at which the radio circuitry of the radio is operable.

7. The antenna assembly of claim 1 wherein the distal end portion of the wire is coupled to the top-hat by way of an electrical connection therewith.

8. The antenna assembly of claim 7 wherein the distal end portion of the wire abuts against a face surface of the top-hat, thereby to form the electrical connection therewith.

9. The antenna assembly of claim 1 wherein the top-hat is comprised of a drawn sheet of metallic material.

10. The antenna assembly of claim 9 wherein the top-hat defines at least one face surface having at least a portion which extends in a planar direction generally orthogonal to a direction in which the distal end portion of the wire extends.

11. The antenna assembly of claim 10 wherein the top-hat comprises a transversely-extending, domed, cap member.

12. The antenna assembly of claim 10 further comprising a supportive plug member having a support surface permitting supportive seating of a face surface of the at least one face surface of the top-hat thereupon.

13. The antenna assembly of claim 12 wherein the electrically-conductive wire is supported to extend through the supportive plug member to be supported thereat.

14. The antenna assembly of claim 13 wherein the supportive plug member is comprised of a molded, thermoplastic material.

15. The antenna assembly of claim 13 wherein at least a portion of the proximal end portion of the electrically-conductive wire extends beneath the supportive plug member to permit thereby electrical connection of the proximal end portion of the wire with the radio circuitry of the radio.

16. The antenna assembly as defined in claim 1, wherein the second coupling portion of the top hat includes a recess for receiving the rod coil associated with the rod.

17. The antenna assembly as defined in claim 16, wherein the recess includes an aperture which circumscribes the coil and rod.

18. The antenna assembly as defined in claim 17, wherein the second coupling portion aperture is substantially round.

19. In a radio having radio circuitry housed within a radio housing body, a combination with the radio circuitry of an antenna assembly, said antenna assembly comprising:

an electrically-conductive wire positioned in the radio housing body, a portion of the electrically-conductive wire configured in a helical shape and having a proximal end and a distal end portion comprised of portions of the wire extending beyond the helical shaped portion, wherein the proximal end portion of the wire is coupled to the radio circuitry;

a top-hat coupled to the distal end portion of the wire, wherein the top-hat is of a surface area of a magnitude related to numbers of windings of the electrically-conductive wire such that the numbers of windings of the wire and the magnitude of the surface area of the top-hat are together determinative of the antenna characteristics, the top hat including an opening; and a rod including a rod coil carried thereon, the rod and coil extending through the top hat opening and out of the radio housing body in an extended position, the rod coil coupled to the top hat at the opening when the rod is in the extended position, whereby the rod coil is coupled to the radio circuitry via the top hat and the electrically conductive wire when the rod is in the extended position.

* * * * *

UNITED STATES PATENT AND TRADEMARK OFFICE

CERTIFICATE OF CORRECTION

PATENT NO. : 5,708,445

DATED : Janaury 13, 1998

INVENTOR(S) : Moller et al.

It is certified that error appears in the above-indentified patent and that said Letters Patent is hereby corrected as shown below:

In column 11, line 2 of claim 3, please remove the comma "," after distal

On the title page, item [57],

Abstract, line 14, please replace "beth" with --both--

Signed and Sealed this

Fourteenth Day of April, 1998

Bruce Lehman

*Attest:*

BRUCE LEHMAN

*Attesting Officer*

*Commissioner of Patents and Trademarks*